US009715979B2

(12) United States Patent
Bresciani et al.

(10) Patent No.: US 9,715,979 B2
(45) Date of Patent: Jul. 25, 2017

(54) LOW VOLTAGE SWITCH POLE

(71) Applicant: Abb S.p.A., Milan (IT)

(72) Inventors: Nicola Bresciani, Bergamo (IT); Pierantonio Arrighetti, Bossico (IT)

(73) Assignee: ABB S.p.A., Milan (IT)

( * ) Notice: Subject to any disclaimer, the term of this patent is extended or adjusted under 35 U.S.C. 154(b) by 0 days.

(21) Appl. No.: 15/003,131

(22) Filed: Jan. 21, 2016

(65) Prior Publication Data

US 2016/0217950 A1 Jul. 28, 2016

(30) Foreign Application Priority Data

Jan. 23, 2015 (EP) ..... 15152348

(51) Int. Cl.
*H01H 33/10* (2006.01)
*H01H 33/42* (2006.01)
(Continued)

(52) U.S. Cl.
CPC ..... *H01H 33/10* (2013.01); *H01H 9/346* (2013.01); *H01H 33/42* (2013.01); *H01H 33/74* (2013.01); *H01H 1/226* (2013.01); *H01H 9/342* (2013.01); *H01H 2009/348* (2013.01); *H01H 2205/002* (2013.01)

(58) Field of Classification Search
CPC .. H01H 2009/305; H01H 1/226; H01H 71/10; H01H 1/50; H01H 2001/5861; H01H 2009/0285; H01H 2009/526; H01H 2033/888; H01H 33/74; H01H 33/88; H01H 3/38; H01H 3/46; H01H 71/0228; H01H 71/08
See application file for complete search history.

(56) References Cited

U.S. PATENT DOCUMENTS 3,632,926 A * 1/1972 Heft ..... H01H 9/346 218/150
4,082,931 A * 4/1978 Hayes ..... H01H 9/34 218/150

(Continued)

OTHER PUBLICATIONS

Extended European Search Report issued Jul. 24, 2015 in EP Appln. 15152348.7.

*Primary Examiner* — Truc Nguyen
(74) *Attorney, Agent, or Firm* — Polsinelli PC

(57) ABSTRACT

A low voltage switch pole which comprises an insulating casing having lateral walls and a front and a rear wall and defining an internal space with a contact area and an arc extinguishing area, a fixed contact assembly and a movable contact assembly being positioned in said contact area, said movable contact assembly being movable between a closed position in which it is into contact with said fixed contact assembly and an open position in which it is spaced apart from said fixed contact assembly, an arc chamber comprising a plurality of substantially parallel metallic plates inserted into an enclosure made of insulating material being positioned in said arc extinguishing area; the switch pole further comprises an insulating wall which is positioned in said internal space between said contact area and said arc extinguishing area and partially separates said contact area from said arc extinguishing area, a channel connecting said contact area to said arc extinguishing area being provided in said insulating wall.

21 Claims, 11 Drawing Sheets

(51) Int. Cl.

| | |
|---|---|
| ***H01H 33/74*** | (2006.01) |
| *H01H 1/22* | (2006.01) |
| *H01H 9/34* | (2006.01) |

(56) References Cited

U.S. PATENT DOCUMENTS 4,088,973 A * 5/1978 Kussy ..... H01H 9/342 335/42
4,218,596 A * 8/1980 Clausing ..... H01H 71/0214 200/304
4,612,426 A * 9/1986 Maier ..... H01H 9/362 218/151
4,958,135 A 9/1990 Baginski et al.
5,899,323 A 5/1999 Rakus
6,222,147 B1 * 4/2001 Doughty ..... H01H 1/2058 218/149
6,248,971 B1 6/2001 Morel et al.
6,281,459 B1 * 8/2001 Munsch ..... H01H 77/108 218/22
6,417,474 B1 * 7/2002 Rakus ..... H01H 9/46 218/148
6,703,576 B1 * 3/2004 Chou ..... H01H 9/342 218/157
7,009,132 B1 * 3/2006 Shea ..... H01H 9/342 218/155
2005/0151605 A1 7/2005 Kruschke
2008/0067042 A1 * 3/2008 Shea ..... H01H 9/302 200/34
2008/0067153 A1 * 3/2008 Pollitt ..... H01H 9/342 218/154
2011/0192822 A1 * 8/2011 Malingowski ..... H01H 9/342 218/157
2012/0298489 A1 * 11/2012 Fong ..... H01H 1/226 200/250
2014/0346146 A1 * 11/2014 Kharade ..... H01H 9/36 218/151
2015/0129551 A1 * 5/2015 Jang ..... H01H 9/047 218/149
2015/0129555 A1 * 5/2015 Jang ..... H01H 9/04 218/157
2016/0111230 A1 * 4/2016 Fonseca ..... H01H 9/0271 361/93.6

* cited by examiner

LOW VOLTAGE SWITCH POLE

CROSS REFERENCE TO RELATED APPLICATIONS

This application claims priority to Application No. 15152348.7 filed in Europe on Jan. 23, 2015 under 35 U.S.C. §119. The entire contents of this European application are hereby incorporated by reference.

The present invention relates to a low-voltage pole for a switching device, in particular a circuit breaker, a disconnector, or a contactor to be used in low-voltage electrical systems, i.e., systems operating at up to approximately 1000 V AC. The invention likewise relates to a low voltage switch comprising one or more of said poles.

It is known that low voltage switching devices, such as for example circuit breakers, disconnectors, contactors, limiters, hereinafter referred to, for reasons of brevity, as switches, comprise one or more electrical poles, associated to each of which there is at least one pair of contacts that can be coupled to and uncoupled from one another. Switches of the known art also comprise control means that cause relative movement of said pairs of contacts so that they can assume at least one first, coupling, position (circuit closed) and one second, separation, position (circuit open). The control means comprise, for instance, mechanisms, which terminate, for example, in a shaft operatively connected to said mobile contacts.

In particular, the circuit breakers are usually provided with a system which ensures the nominal current required for the various users, the connection and disconnection of the load, protection against any abnormal conditions (such as overloading and short-circuit) by automatically opening the circuit, and the disconnection of the protected circuit by opening the moving contacts with respect to the fixed contacts (galvanic separation) in order to achieve full isolation of the load with respect to the electric power source.

The critical function of interrupting the current (whether nominal, overload or short-circuit current) is provided by the circuit breaker in a specific portion of said circuit breaker which is constituted by the so-called deionizing arc chamber.

Thus, generally associated to each pole of a low voltage switch there is at least one arc chamber, i.e., a region of space particularly designed to foster electric-arc interruption. Arc chambers can be simple regions provided in the casing of the switch, or else can comprise various modular elements shaped, for example, like casings made of insulating material equipped with arc-breaking plates. Modular arc chambers, which are more advanced, present the advantage of being easily replaceable and of being doable with materials that are more suitable as compared, for example, to the ones used for the casing of the switch.

As a consequence of the opening movement, the voltage between the contacts causes the dielectric discharge of the air, leading to the formation of the electric arc in the chamber. The arc is propelled by electromagnetic and fluid-dynamics effects inside a series of arc-breaking metal plates arranged in the chamber, which are meant to extinguish said arc by cooling and splitting actions.

During arc forming, the energy released by Joule effect is very high and causes thermal and mechanical stresses inside the plate containment region. In order to withstand these stresses, the design of the arc chamber must be evaluated carefully so as to obtain a component which is solid enough to withstand the thermal and mechanical stresses.

Indeed, one of the problems normally present in low voltage switch devices of known type is the uneven distribution of the arc among the metallic plates of the arc chamber, resulting in a not uniform and less effective utilization of the arc-breaking plates. In other words, it can happen that the arc by-passes at least some of the metallic plates, thereby resulting in a higher concentration of stresses and higher temperatures in some area of the arc chamber with a consequent less effective arc quenching.

It is worth noting that, in addition to the above problems, a non-uniform utilization of the arc-breaking plates normally adversely effects the lifetime of the arc chamber with an early decay of its characteristics and hence degradation of the performance of the low voltage switch itself.

Moreover, the design of the chamber must guarantee appropriate guidance of the arc into the extinguishing region while providing protection of the regions that must not be affected.

Indeed, if insulation is not optimal, it is possible in some instances that the arc "escapes" (current leakage) from the arc chamber with very dangerous arc formation between the movable contacts and other metallic parts outside the interruption region, such as the driving mechanisms or other accessories of the low voltage switch.

On the basis of the above considerations, there is a need to have available alternative technical solutions that will enable the limits and the problems set forth above to be overcome. Hence, the present disclosure is aimed at providing a low voltage switch pole which allows overcoming at least some of the above mentioned shortcomings.

In particular, the present invention is aimed at providing a low voltage switch pole in which a more uniform utilization of the arc chamber plates is guaranteed, by involving all metal plates during the arc quenching.

A further object of the present invention is to provide a low voltage switch pole in which insulation is guaranteed and the risk of arc formation/current leakage with metallic parts outside the interruption region is avoided.

A still further object of the present invention is to provide a low voltage switch pole that is reliable and relatively easy to produce at competitive costs.

Thus, the present invention relates to a low voltage switch pole which comprises an insulating casing having lateral walls, a front and a rear wall and defining an internal space with a contact area and an arc extinguishing area. A fixed contact assembly and a movable contact assembly are positioned in said contact area, said movable contact assembly being movable between a closed position in which it is into contact with said fixed contact assembly and an open position in which it is spaced apart from said fixed contact assembly; the low voltage switch pole of the invention further comprises an arc chamber positioned in said arc extinguishing area, said arc chamber comprising a plurality of substantially parallel metallic plates inserted into an enclosure made of insulating material. The low voltage switch pole according to the invention is characterized in that an insulating wall is positioned in said internal space between said contact area and said arc extinguishing area and partially separates said contact area from said arc extinguishing area, and in that a channel connecting said contact area to said arc extinguishing area is provided in said insulating wall.

A low voltage switch, e.g. a low voltage circuit breaker, comprising a low voltage switch pole as described in the present disclosure is also part of the present invention.

For the purposes of the present invention, the relative terms used in this disclosure, e.g. "front", "rear", "lateral", as well as the terms "upper" and "lower", relate to the low voltage switch pole under operation conditions when in a "vertical" installation.

As better explained in the following description, thanks to the particular structure and functionality of the low voltage switch pole of the present invention it is possible to have an optimal utilization of substantially all metallic plates of the arc chamber which are progressively interested by the arc during the opening operation.

In practice, the contact area and the arc extinguishing area in the internal space of the insulating casing of low voltage switch pole are at least partially separated from each other by the insulating wall. When the movable contacts start separating from the fixed contacts, an arc is initially formed in the area of the arc chamber close to the fixed contacts. Then the arc develops throughout the arc chamber, and the insulating wall avoid that the arc "jumps" directly onto the terminal plate, by-passing some of the intermediate plates.

In this respect, the channel connecting the contact area to the arc extinguishing area in the internal space of the insulating casing conveys the hot gases into the portion of the arc chamber opposite to the fixed contacts and beyond the terminal plate, thereby stripping the arc throughout the arc chamber involving all metal plates. At the same time, the insulating wall avoids any arc striking toward the exterior of the interruption zone, i.e. avoids any arc/current leakage between the movable contacts and the external metallic parts.

Thus, in the low voltage switch pole according to the invention the contact area and the arc extinguishing area in the internal space of the insulating casing are in direct communication with each other in a region near the fixed contact assembly; in the region opposite to the fixed contact assembly, the contact area and the arc extinguishing area in the internal space of the insulating casing are separated from each other by the insulating wall but, at the same time, a communication between them is maintained through the channel which is formed into the insulating wall and connects the contact area to the arc extinguishing area.

Advantageously the low voltage switch pole according to the invention has a modular structure and the insulating casing comprises a first half shell and a second half shell that are coupled to each other. In practice, according to this embodiment, each of the two half-shells comprises one of the two lateral walls, at least a portion of the front wall and at least a portion of the rear wall of the insulating casing.

In a largely preferred embodiment of the low voltage switch pole of the invention, the channel between the contact area and the arc extinguishing area in the internal space of the insulating casing connects a middle portion of said contact area with a terminal portion of said arc extinguishing area. In this regard, the term "terminal portion" is meant to designate the portions of the contact area and of the arc extinguishing area in correspondence of the open position of said movable contact assembly, the term "initial portion" is meant to designate the portions of the contact area and of the arc extinguishing area in correspondence of the closed position of said movable contact assembly, and the term "middle portion" is meant to designate the portions of the contact area and of the arc extinguishing area in correspondence of intermediate positions of said movable contact assembly between its open and closed positions.

Thus, according to this preferred embodiment, once the movable contact assembly has reached an intermediate position between the closed position and the open position, the hot gases are conveyed through the channel from the contact area to the terminal portion of the arc extinguishing area, thereby helping (urging) the arc development throughout substantially all metal plates.

Preferably said insulating wall is positioned in the internal space of the insulating casing opposite to said fixed contact assembly.

In practice, the fixed contact assembly is normally positioned in correspondence of the rear wall of the insulating casing and the insulating wall is preferably positioned in the internal space of the insulating casing in correspondence of the open position of said movable contact assembly, i.e. in correspondence of the front wall of the insulating casing.

In a further preferred embodiment of the low voltage switch pole of the invention, said insulating wall is integral with said front wall and said lateral walls of said insulating casing and extends in said internal space from said front wall towards said fixed contact assembly and said rear wall. Thus, when the insulating casing is made of two half shells, also the insulating wall is divided into two parts, each one being integral with a corresponding half shell.

In such a case, preferably, said insulating wall has a terminal edge in correspondence of a middle portion of said contact area and said channel has a first opening communicating with said contact area proximate to said terminal edge and a second opening communicating with said arc extinguishing area proximate to said front wall. In other words, according to this embodiment, the channel develops substantially horizontally inside the insulating wall so as to put into communication the middle portion of the contact area with the terminal portion of the arc extinguishing area.

Preferably, the metallic plates of the arc chamber are inserted into said enclosure of said arc chamber at a distance from said contact area and from said movable and fixed contact assemblies. In other words, the metallic plates are inserted into the arc chamber so as to have a gap between them and the contact area.

Then the arc chamber normally comprises a terminal metallic plate that closes the arc chamber and is preferably positioned so as to substantially rest on said insulating wall.

In such a case, said channel opens into said arc extinguishing area between said terminal metallic plate and said front wall, i.e. the channels opens into the arc extinguishing area beyond the whole assembly of metallic plates of the arc chamber and close to the front wall of the insulating casing of the pole.

Further features and advantages of the present invention will be more clear from the description of preferred but not exclusive embodiments of a low voltage switch pole according to the invention, shown by way of examples in the accompanying drawings, wherein.

Figure 3:
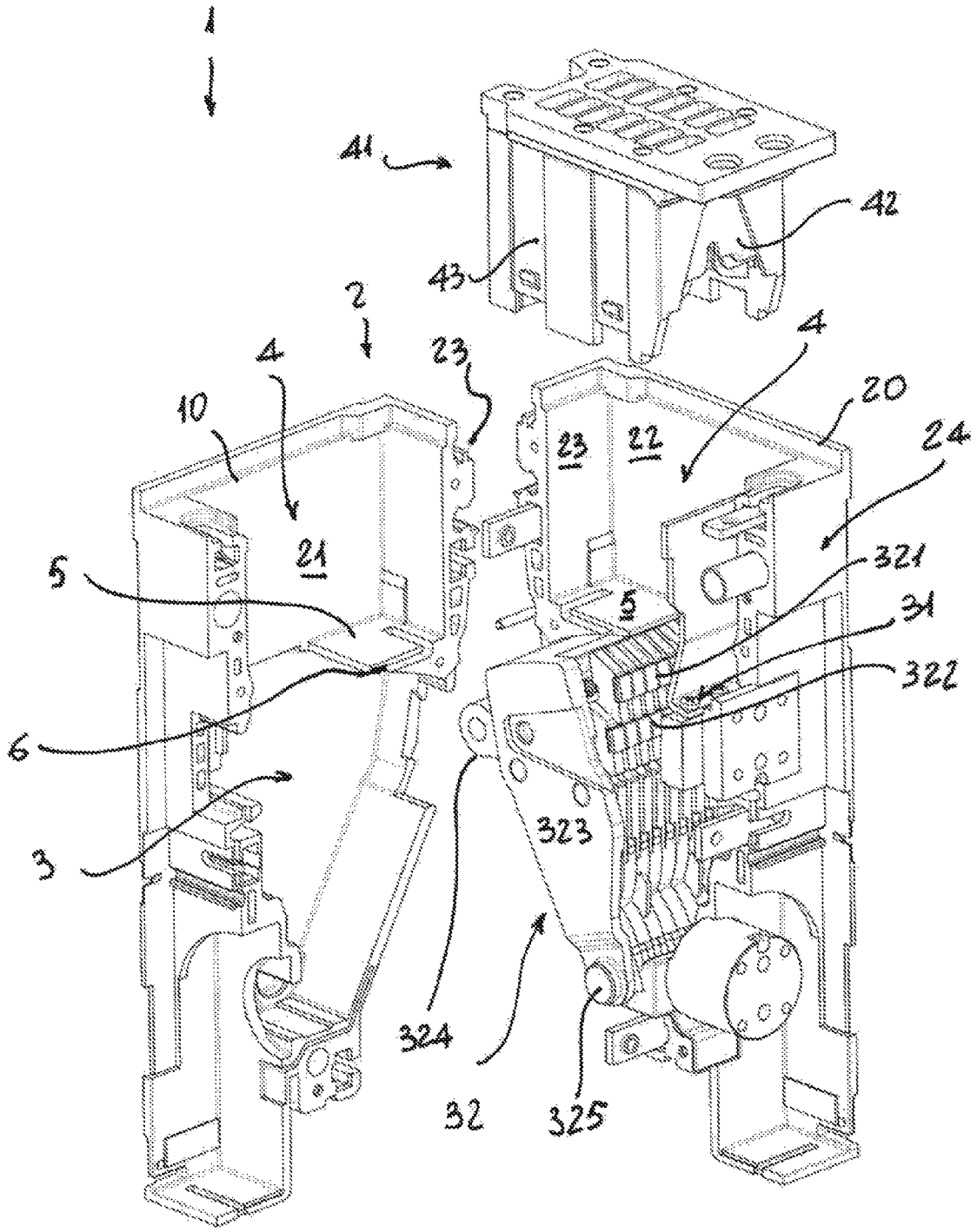
FIG. 3 is an exploded view of an embodiment of a low voltage switch pole according to the invention.

With reference to the attached figures, in particular to FIG. 3, a low voltage switch pole according to the invention, generally designated with the reference numeral 1, comprises in its more general definition an insulating casing 2 having a first 21 and a second 22 lateral wall, a front wall 23 and a rear wall 24. As represented in the attached figures, the insulating casing 2 preferably comprises a first half shell 10 and a second half shell 20 that are coupled to each other so as to form the insulating casing 2. In practice, the first half shell 10 comprises the first lateral wall 21, at least a portion of the front wall 23 and at least a portion of the rear wall 24, while the second half shell 20 comprises the second lateral wall 22, at least a portion of the front wall 23 and at least a portion of the rear wall 24.

The internal space defined by the insulating casing 2 comprises a contact area 3 and an arc extinguishing area 4 which is positioned at an upper level with respect to said contact area 3.

A fixed contact assembly 31, comprising electrical contacts 311, 312 is positioned inside the contact area 3 in correspondence of the rear wall 24 of the insulating casing 2. Likewise, a movable contact assembly 32 is also positioned in said contact area 3, said movable contact assembly 32 being movable between a closed position in which it is into contact with the fixed contact assembly 31 and an open position in which it is spaced apart from said fixed contact assembly 31.

In the embodiment shown in the figures, the movable contact assembly 32 generally comprises electrical contacts 321, 322, and a supporting structure 323 for supporting the contacts 321, 322 which is rotatably mounted on an axis 325 so as to allow engagement/disengagement of the contacts 321, 322 to/from the contacts 311, 312 of the fixed contact assembly 31. The supporting structure 323 also comprises a connecting element 324 which protrudes outside the insulating casing 2 from a window in the front wall 23 for connection with a driving mechanism (not shown) operating the opening/closing of the movable contact assembly 32. Different structures of the movable contact assembly 32 are however possible.

The low voltage switch pole 1 according to the invention also comprises an arc chamber 41 which in turn comprises a plurality of substantially parallel metallic plates 42 inserted into an enclosure 43 made of insulating material. Said arc chamber 41 is inserted into said arc extinguishing area 4 so as to be positioned above said contact area 3.

One of the characterizing features of the low voltage switch pole 1 according to the invention is that an insulating wall 5 is positioned in said internal space between said contact area 3 and said arc extinguishing area 4 and partially separates said contact area 3 from said arc extinguishing area 4. In this way, the contact area 3 and the arc extinguishing area 4 are in direct communication with each other in the region near the fixed contact assembly 31 (i.e. near the rear wall 24 of the insulating casing 2), thereby allowing arc formation in the arc chamber 41. Conversely, in the region near the front wall 23 of the insulating casing 2 (i.e. opposite to the fixed contact assembly 31), the contact area 3 and the arc extinguishing area 4 are isolated from each other by the insulating wall 5, thereby avoiding a "jump" of the arc directly on the terminal plates of the arc chamber 41, bypassing some of the intermediate metallic plates 42.

In practice, as shown in the attached figures, the insulating wall 5 can be conveniently positioned in said internal space opposite to said fixed contact assembly 31, i.e. in correspondence of the front wall 23 of the insulating casing 2.

A further characterizing features of the low voltage switch pole 1 according to the invention is that a channel 6 is provided in the insulating wall 5. The channel 6 put the contact area 3 into communication with the arc extinguishing area 4, allowing a passage of the hot gas developed during arc formation from the contact area 3 to the arc extinguishing area 4.

As previously explained, the hot gas flows into the terminal portion of the arc chamber 41 and greatly improves the fluid dynamics inside the arc chamber 41, helping (urging) the arc to develop throughout the whole arc chamber 41 and involving all metal plates 42. In particular, the channel 6 connects a middle portion of said contact area 3 with a terminal portion of said arc extinguishing area 4, i.e. the hot gases start passing through the channel 6 from the contact area 3 to the arc extinguishing area 4 when the movable contact assembly 32 is in an intermediate position between the closed position and the open position.

Figure 4:
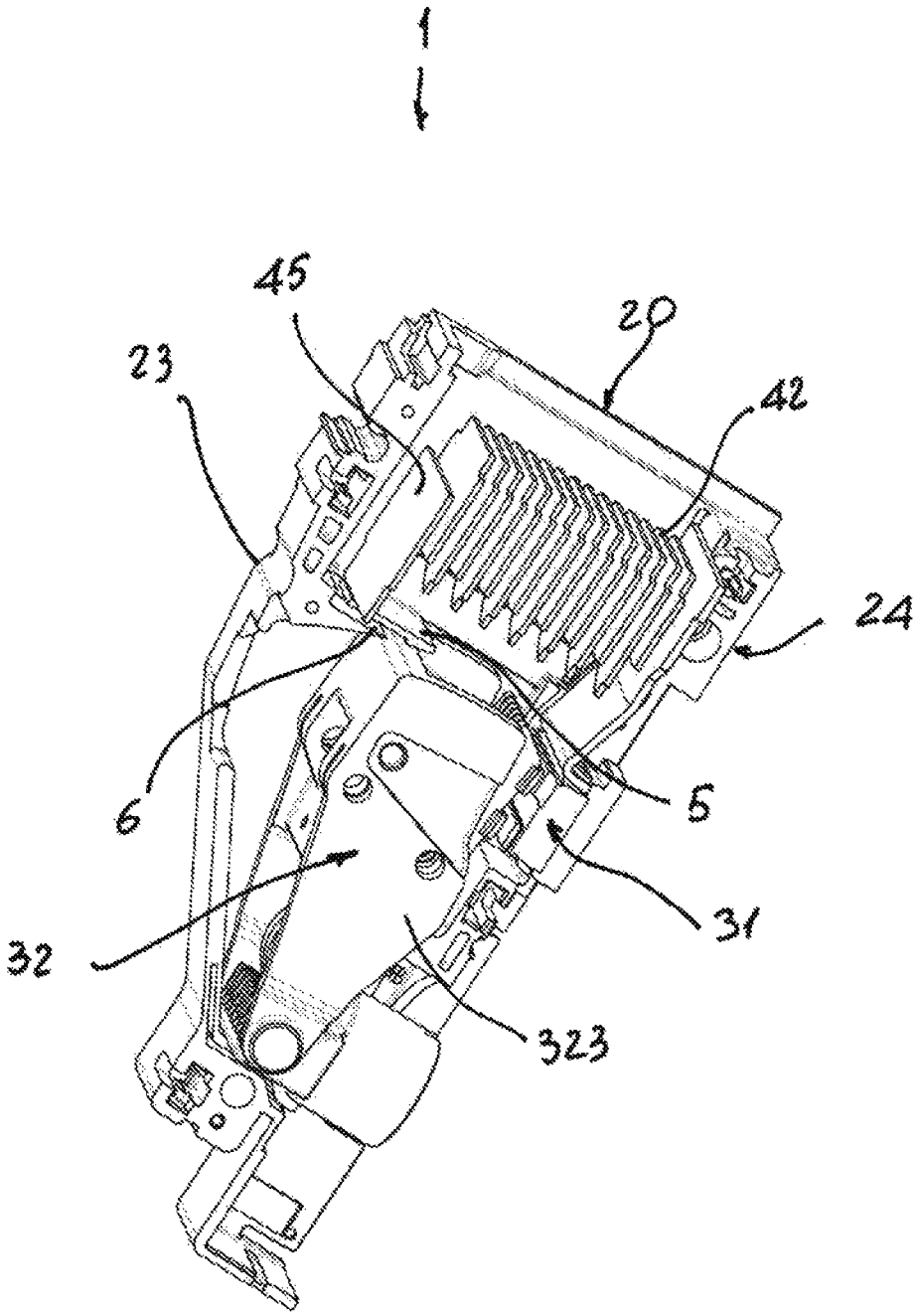
FIG. 4 is a perspective view of the low voltage switch pole of FIG. 3 at the initial movement of the movable contact assembly from the closed position.
Figure 5:
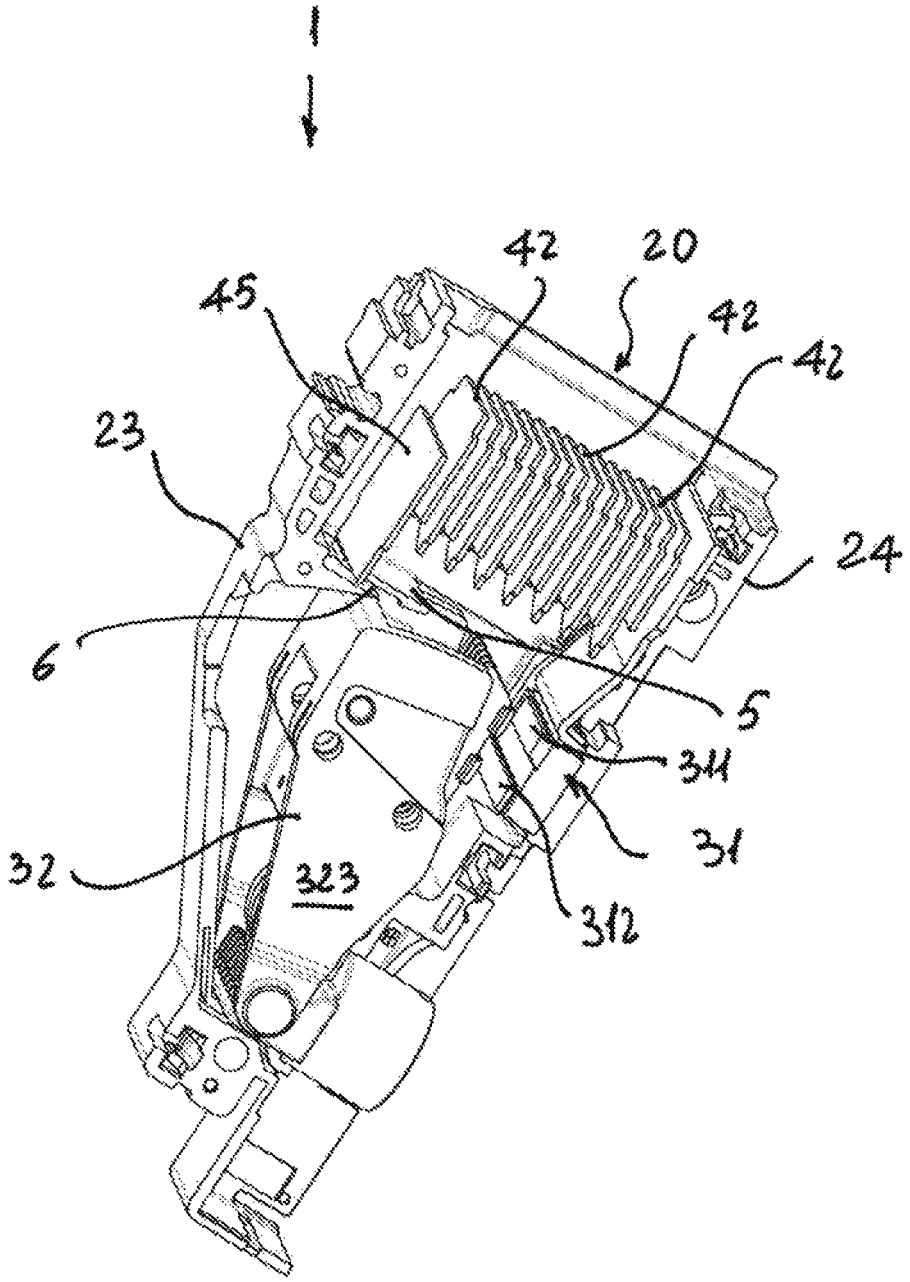
FIG. 5 is a perspective view of the low voltage switch pole of FIG. 3 in a first intermediate position of the movable contact assembly.
Figure 6:
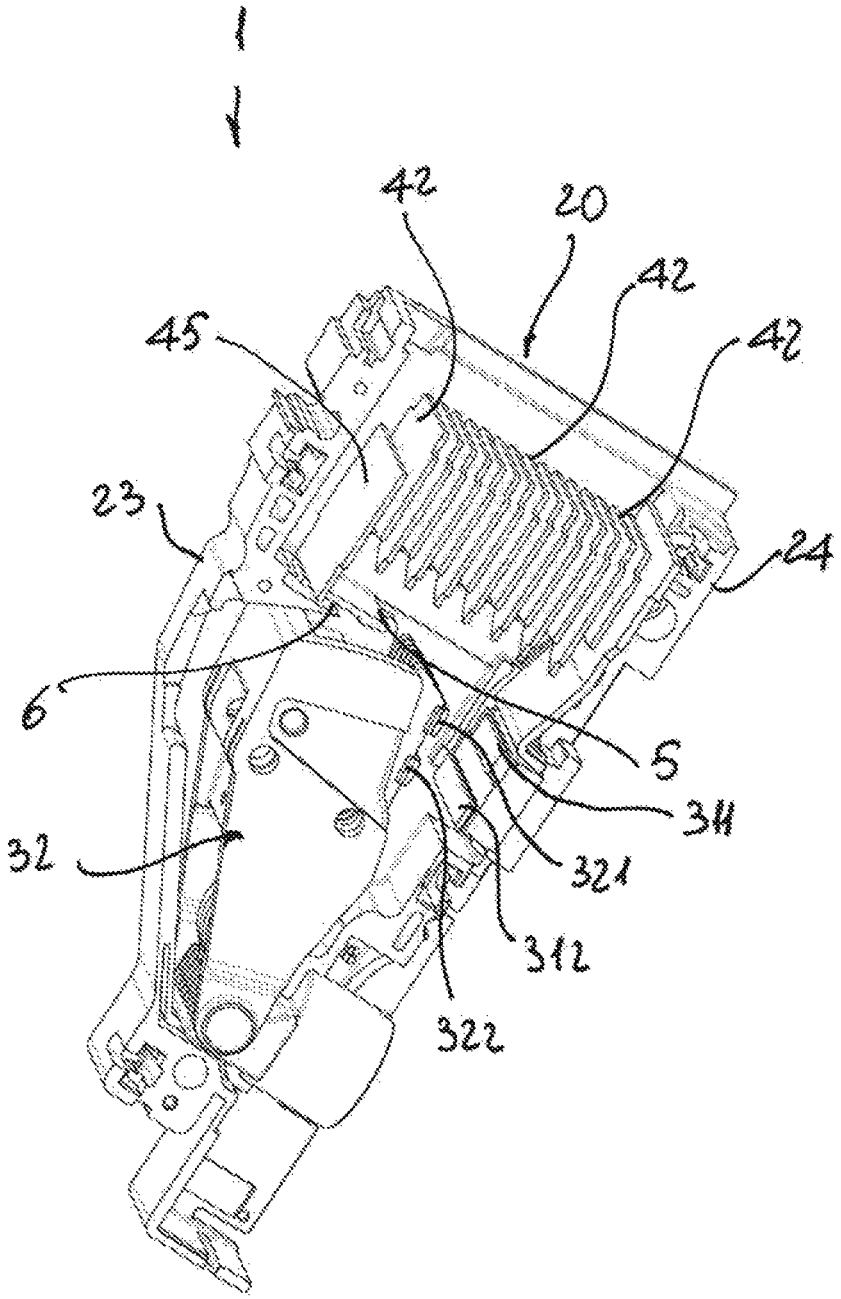
FIG. 6 is a perspective view of the low voltage switch pole of FIG. 3 in a second intermediate position of the movable contact assembly.
Figure 8:
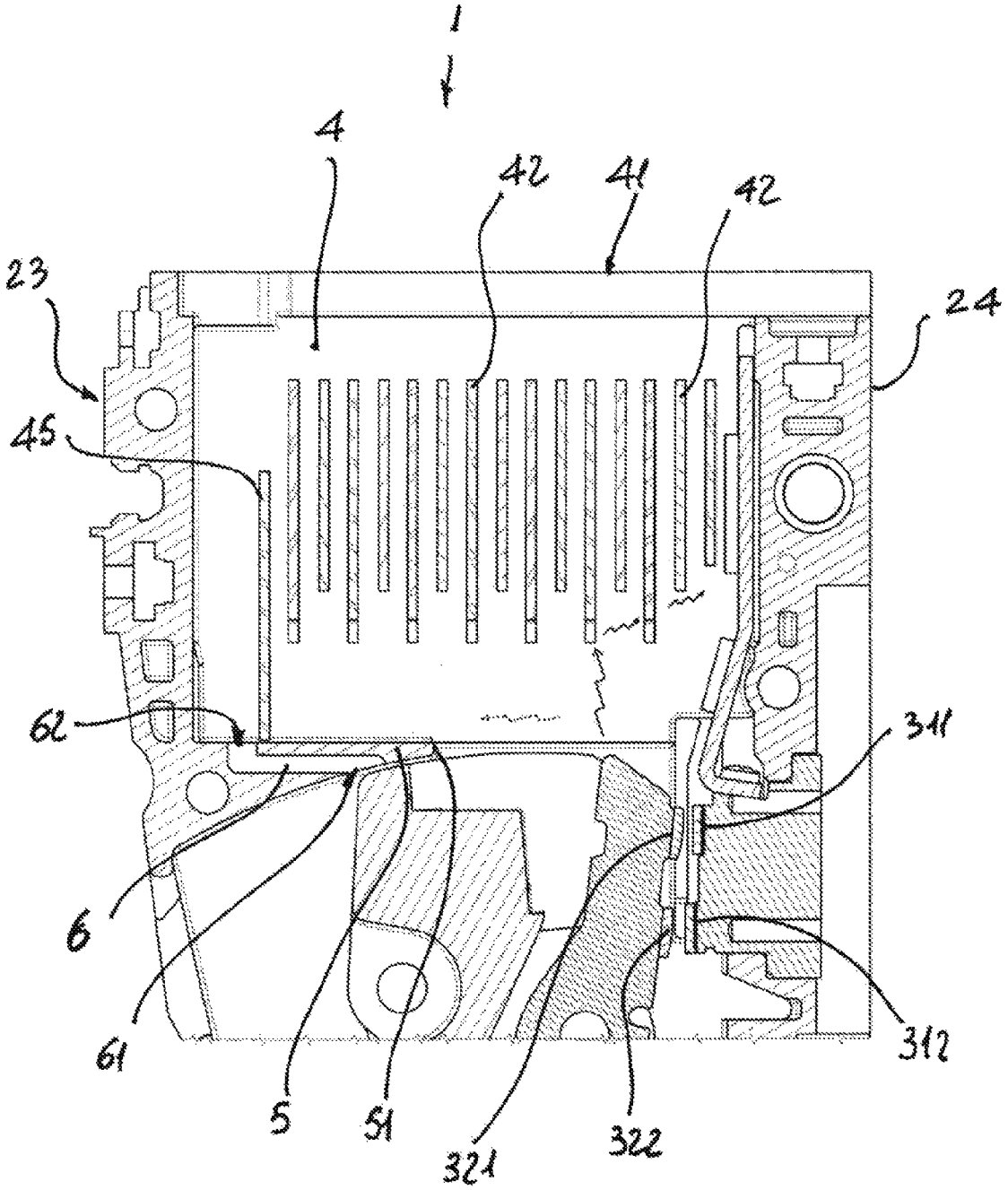
FIG. 8 is a plan view of the low voltage switch pole of FIG. 3 at the initial movement of the movable contact assembly from the closed position.
Figure 9:
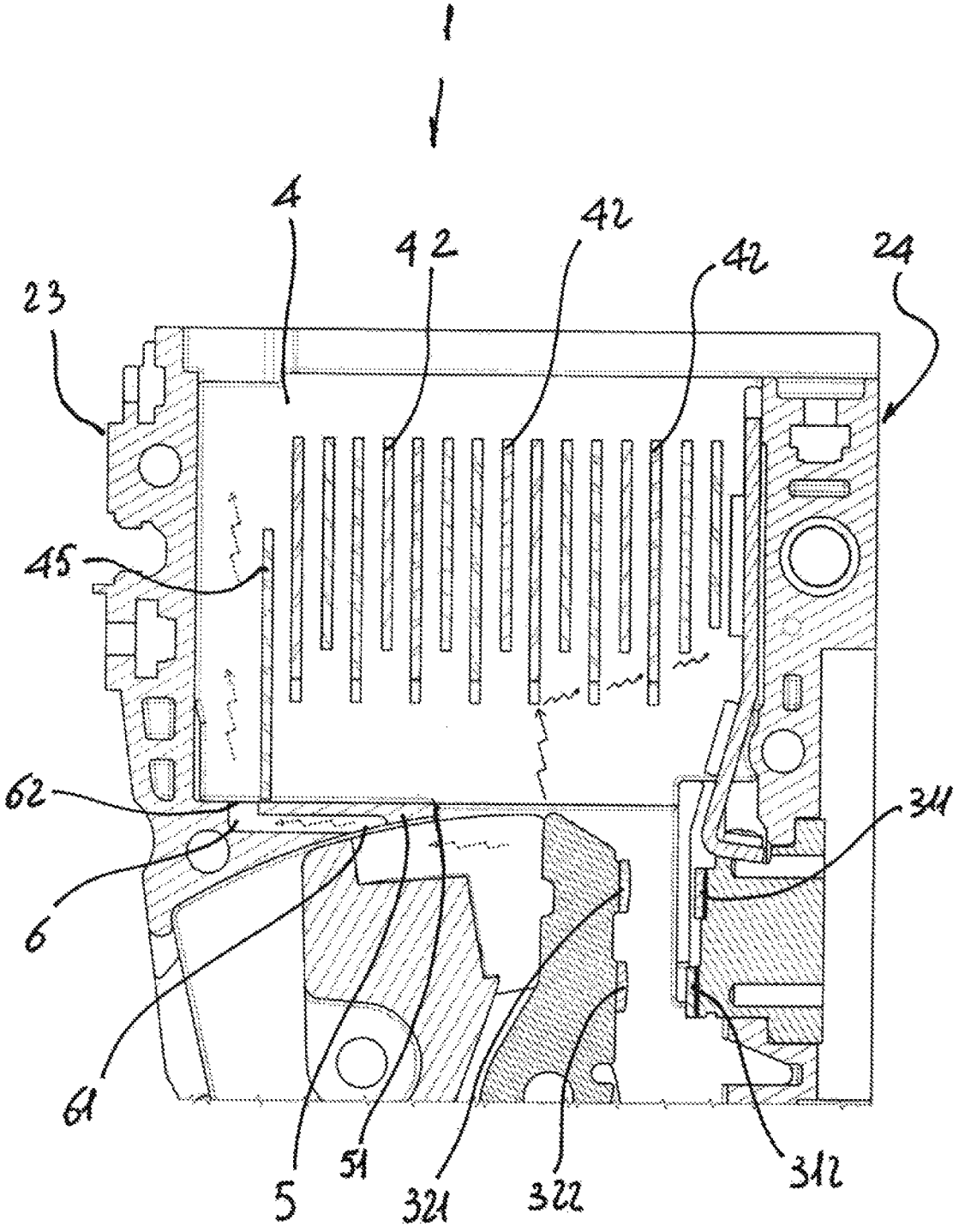
FIG. 9 is a plan view of the low voltage switch pole of FIG. 3 in a first intermediate position of the movable contact assembly.
Figure 10:
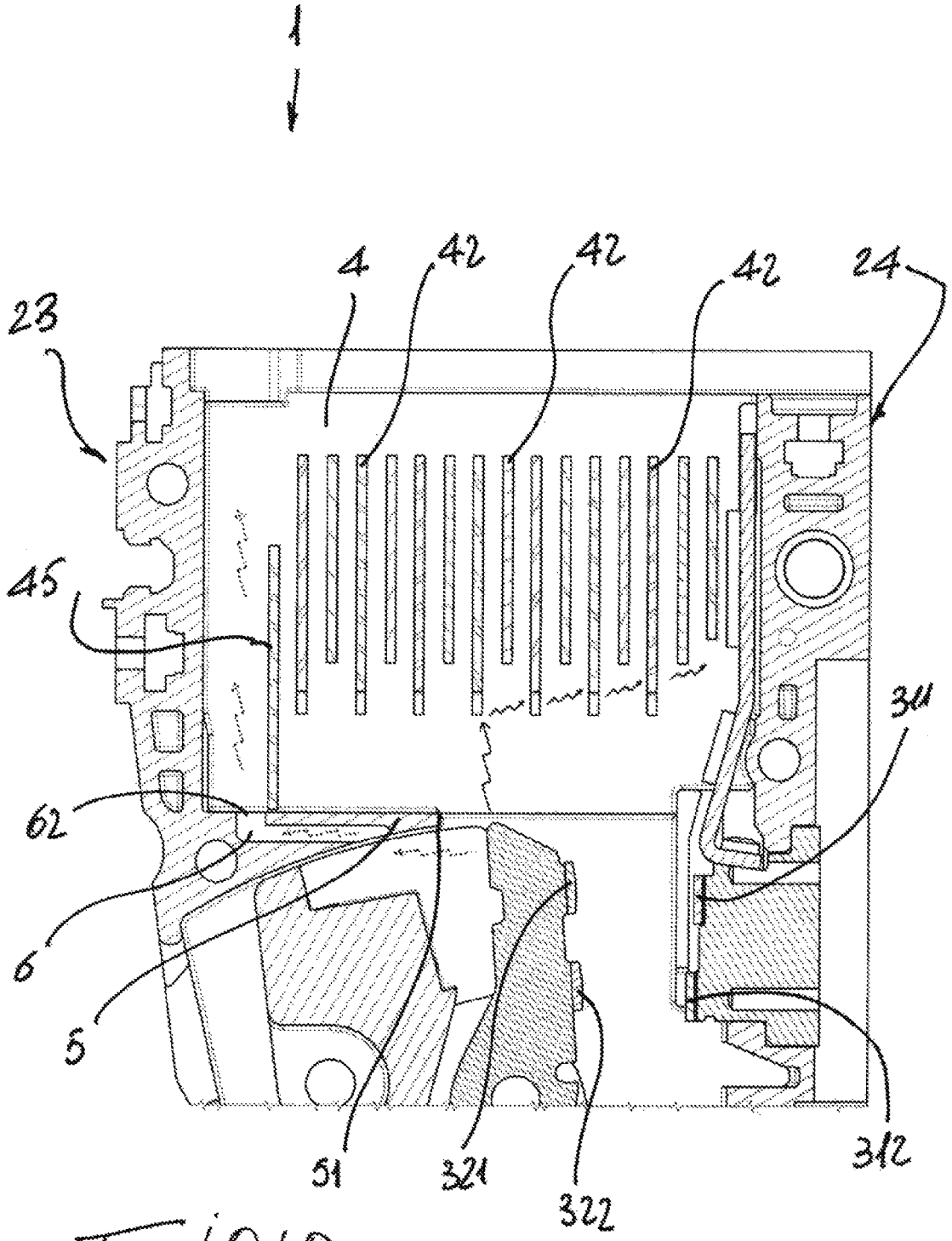
FIG. 10 is a plan view of the low voltage switch pole of FIG. 3 in a second intermediate position of the movable contact assembly.

In practice, with reference to FIGS. 4 and 8, when the movable contacts assembly 32 starts separating from the fixed contact assembly 31, an electrical arc (schematically illustrated as solid arrows between plates) is formed in the initial portion of the arc chamber 41 involving the first metallic plates 42 (i.e. those on the right hand side which are closer to the fixed contact assembly 31).

Then, while the movable contacts assembly 32 is travelling in the intermediate positions of FIGS. 5, 9 and 6, 10, the arc (schematically illustrated as solid arrows between plates) continues developing also in the middle portion of the arc chamber 41 involving also the metal plates 42 present in said middle portion; at the same time, the hot gases (schematically illustrated as dotted arrows) flow due to pressure build up from the contact area 3 into the channel 6 and then into the terminal portion of the arc chamber 41.

Figure 7:
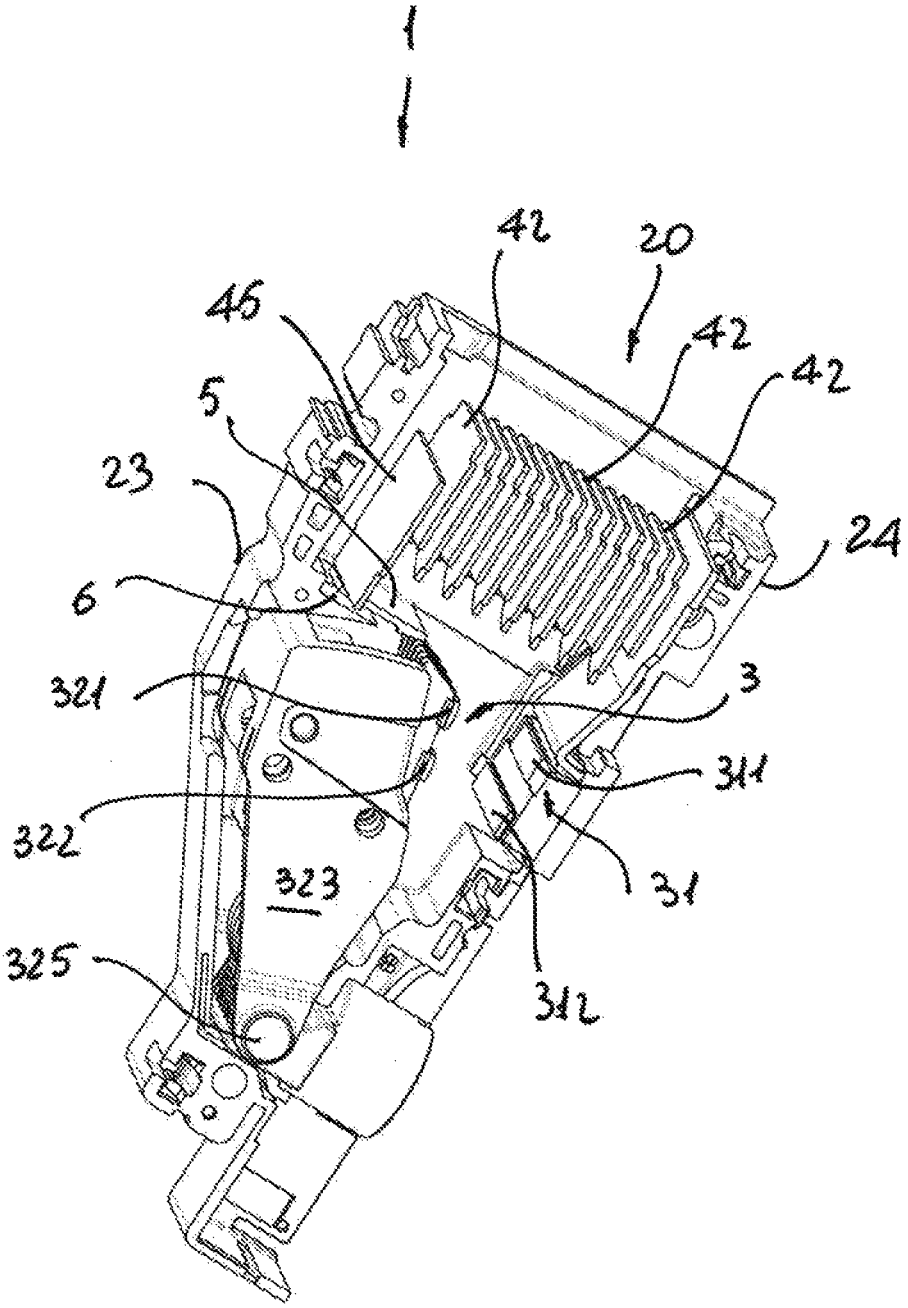
FIG. 7 is a perspective view of the low voltage switch pole of FIG. 3 in the open position of the movable contact assembly.
Figure 11:
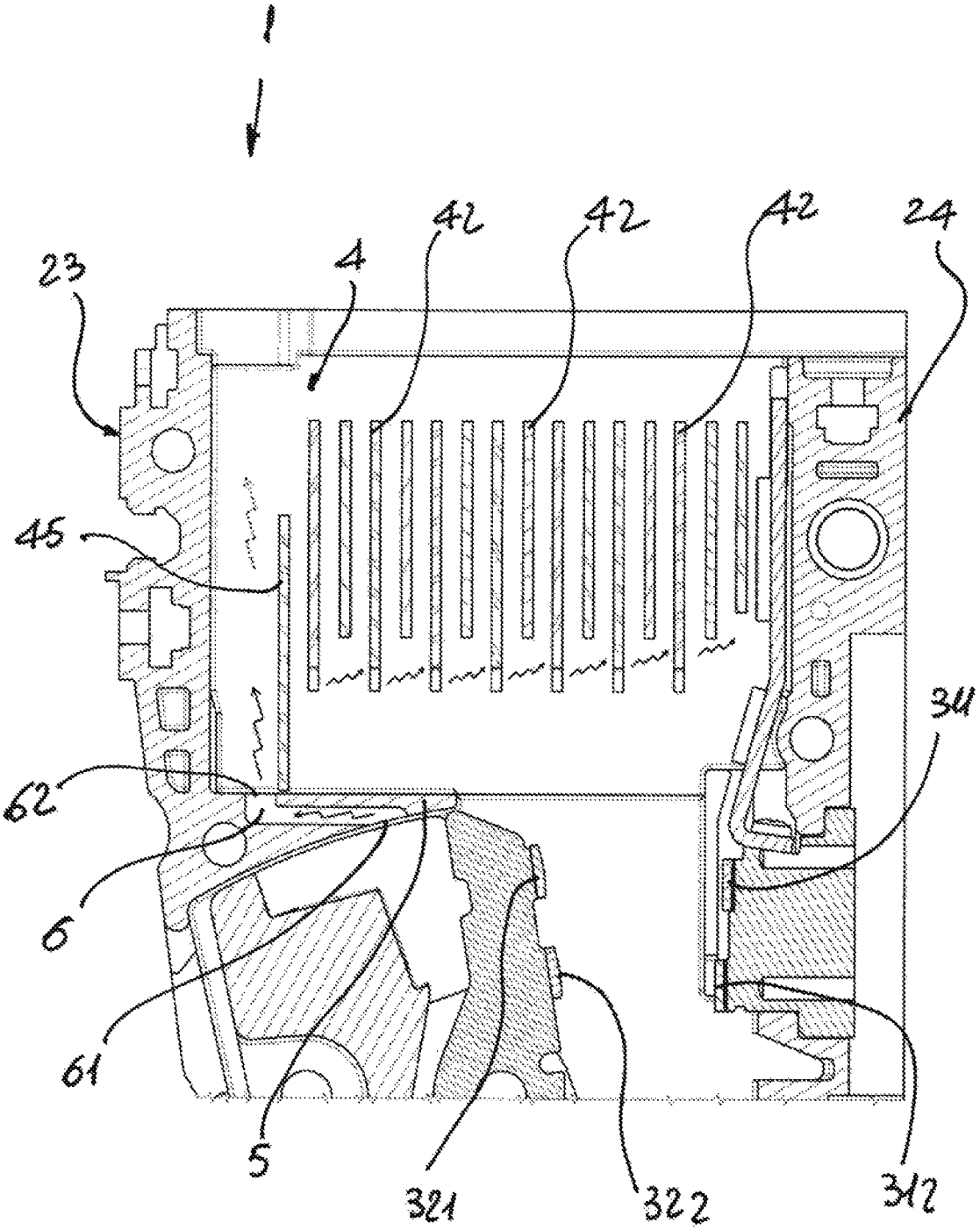
FIG. 11 is a plan view of the low voltage switch pole of FIG. 3 in the open position of the movable contact assembly.

Finally, when the movable contacts 32 is substantially in the open position of FIGS. 7, 11, the arc has developed throughout the whole arc chamber 41 involving substantially all metallic plates 42. As clearly shown in this latter figures, the insulating wall 5 is conveniently positioned in the internal space of the insulating casing 2 in correspondence of the open position of said movable contact assembly 32, thereby guaranteeing a perfect electrical insulation and avoiding any risk of arc striking/current leakage toward the external.

From a construction standpoint, in the low voltage switch pole 1 according to the present invention the insulating wall 5 is preferably made integral with the front wall 23 and the lateral walls 21 and 22 of the half shells 10 and 20 of the insulating casing 2. The insulating wall 5 extends in the internal space of the insulating casing 2 from said front wall 23 in the direction of the fixed contact assembly 31 and of the rear wall 24, so as to partially separate the contact area 3 from the arc extinguishing area 4.

In practice, in the embodiment illustrated in the figures, the insulating wall 5 has a terminal edge 51 in correspondence of a middle portion of said contact area 3. The channel 6 has therefore a first opening 61 which communicates with said contact area 3 proximate to said terminal edge 51 and a second opening 62 which communicates with said arc extinguishing area 4 proximate to the front wall 23 of the insulating casing 2. As previously said, in this way it is possible to convey the hot gases from the middle portion of the contact area 3 to the terminal portion of the arc chamber 41.

The metallic plates 42 of the arc chamber 41 can have different dimensions and shapes according to the needs. The metallic plates 42 are generally inserted into the enclosure 43 of said arc chamber 41 so that in the operating position a certain gap is left between their lower edge and said contact area 3, as well as between their lower edge and said movable 32 and fixed 31 contact assemblies.

In a largely preferred embodiment of the low voltage switch pole 1 according to the present invention, said arc chamber 41 comprises a terminal metallic plate 45 acting as a "roof" for said arc chamber 41, i.e. acting so as to close the arc chamber 41 in the terminal portion thereof.

In practice, the terminal metallic plate 45 is inserted into the insulating enclosure 43 of said arc chamber 41 at a lower level with respect to the other metallic plates 42, so as to be located, when in the operating position, substantially in contact with, or very close to, the insulating wall 5.

In such a case, the channel 6 has a first opening 61 which communicates with said contact area 3 in correspondence of a middle portion thereof and a second opening 62 which communicates with said arc extinguishing area 3 at a point between said terminal metallic plate 45 and said front wall 23. In other words, according to this largely preferred embodiment the hot gases are vented from the contact area 3 to a position in the arc chamber 41 which is beyond the "roof" formed by the terminal metallic plate 45.

As is clear from the above description, the technical solutions adopted for the low voltage switch pole according to the present invention allow the proposed aims and the objects to be fully achieved.

In particular, substantially all metal plates 42 are involved during the arc quenching thereby allowing a more uniform utilization of the arc chamber 41. Less mechanical and thermal stresses are therefore generated into the arc chamber 41 with a consequent prolonged lifetime of it and of the associated switch pole.

Thanks to the insulating wall 5, the possibility for the arc to bypass some of the intermediate metal plates 42 is substantially avoided and is also avoided or considerably reduced any risk of arc strikes toward the external of the pole 1. At the same time, thanks to the channel 6 provided in the insulating wall 5, the fluid dynamics of the hot gases is greatly improved, contributing to stripping the arc throughout the arc chamber 41 so as to involve all metal plates 42. The improved flow of hot gases from the contact area 3 to the arc extinguishing area 4 also helps cooling the movable contacts.

A low voltage switch 100 comprising at least one low voltage switch pole 1 as previously described is also part of the present invention.

Figure 1:
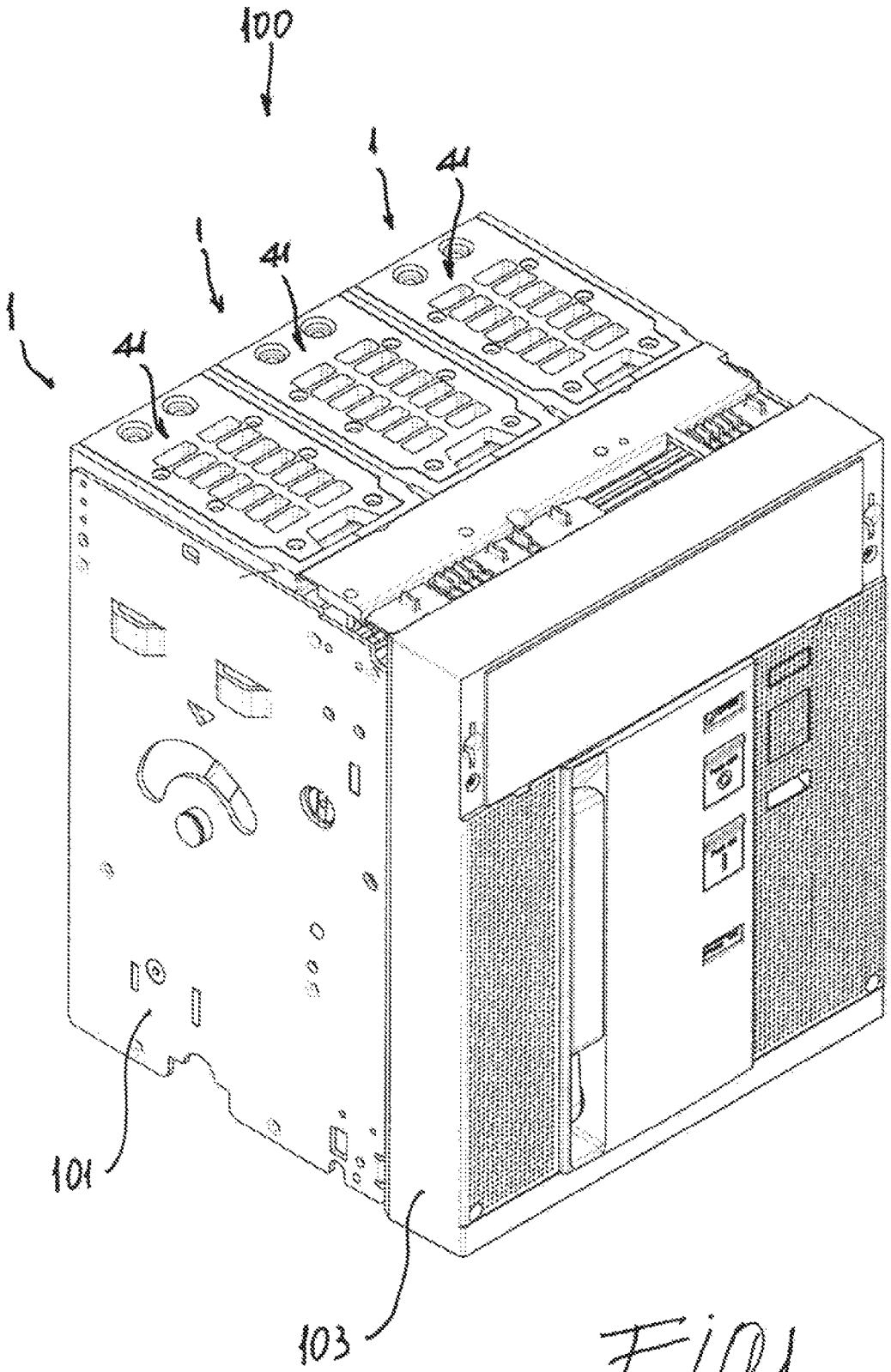
FIG. 1 is a perspective view of a low voltage switch comprising a low voltage switch pole according to the invention.
Figure 2:
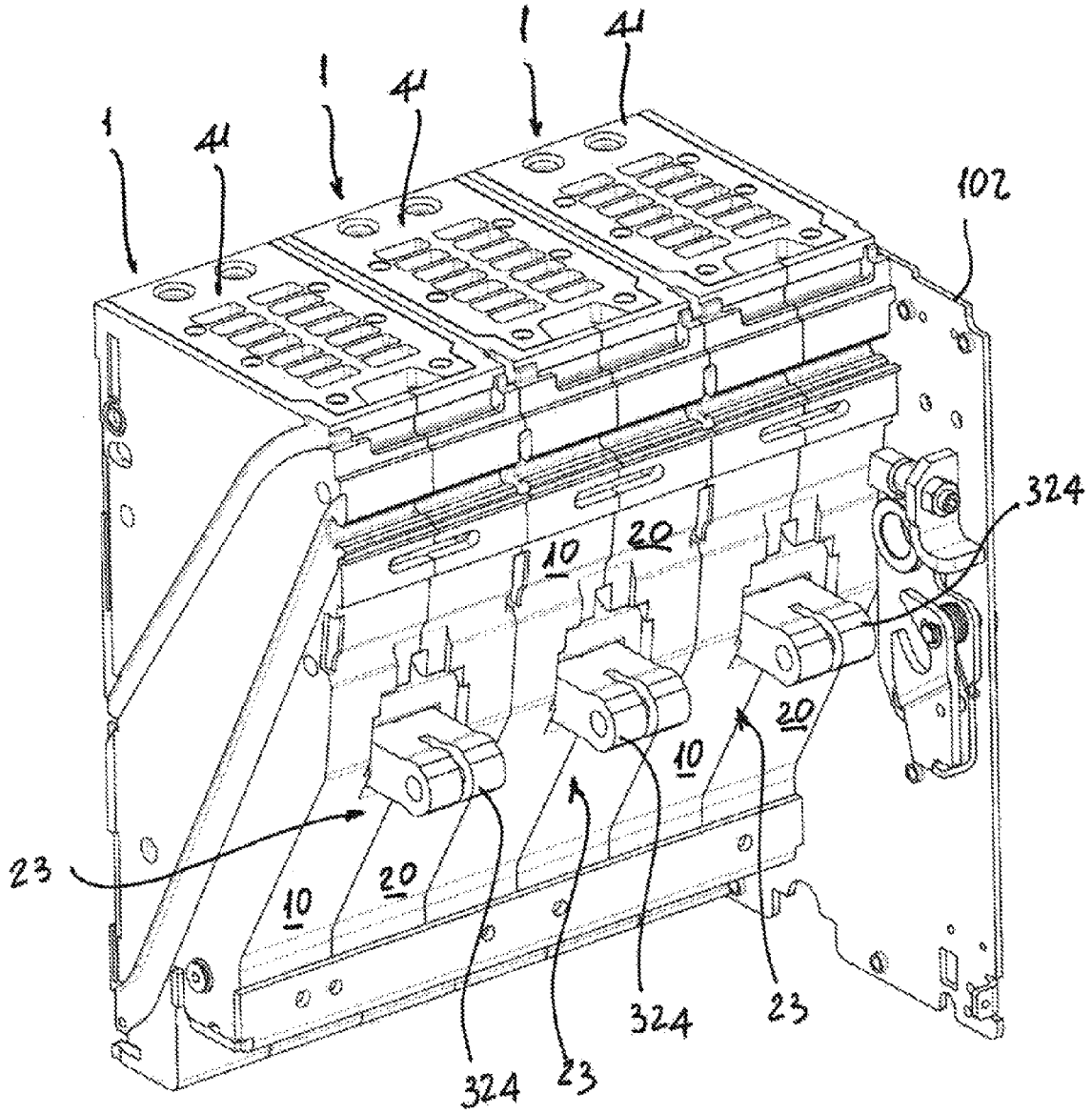
FIG. 2 is a perspective view showing the poles arrangement of the low voltage switch of FIG. 1.

With reference to FIGS. 1 and 2, a three pole low voltage circuit breaker 100 comprising three low voltage switch poles 1 (i.e. circuit breaker poles) is shown. In this embodiment, the insulating casing 2 of each pole 1 is made of two half shells 10 and 20, and the poles 1 are positioned side by side in a supporting a containing structure having rigid flanks 101 and 102, as well as a cover 103. From windows in the front side 23 of the insulating casings 2, connecting elements 324 protrude outside for connection with a driving mechanism (not shown). The general structure of such low voltage circuit breaker is well known in the art and therefore will be not described in more details.

Several variations can be made to the low voltage switch pole thus conceived, all falling within the scope of the attached claims. In practice, the materials used and the contingent dimensions and shapes can be any, according to requirements and to the state of the art.

The invention claimed is:

1. A low voltage switch pole comprising an insulating casing having lateral walls and a front and a rear wall and defining an internal space with a contact area and an arc extinguishing area, a fixed contact assembly and a movable contact assembly being positioned in said contact area, said movable contact assembly being movable between a closed position in which it is into contact with said fixed contact assembly and an open position in which it is spaced apart from said fixed contact assembly, an arc chamber comprising a plurality of substantially parallel metallic plates inserted into an enclosure made of insulating material being positioned in said arc extinguishing area, characterized in that an insulating wall is positioned in said internal space between said contact area and said arc extinguishing area and partially separates said contact area from said arc extinguishing area, and in that a channel connecting said contact area to said arc extinguishing area is provided in said insulating wall.

2. The low voltage switch pole according to claim 1, wherein said insulating casing comprises a first half shell and a second half shell.

3. The low voltage switch pole according to claim 1, wherein said channel connects a middle portion of said contact area with a terminal portion of said arc extinguishing area.

4. The low voltage switch pole according to claim 1, wherein said insulating wall is positioned in said internal space opposite to said fixed contact assembly.

5. The low voltage switch pole according to claim 1, wherein said insulating wall is positioned in said internal space in correspondence of the open position of said movable contact assembly.

6. The low voltage switch pole according to claim 1, wherein said insulating wall is integral with said front wall and said lateral walls of said insulating casing and extends in said internal space from said front wall towards said fixed contact assembly and said rear wall.

7. The low voltage switch pole according to claim 1, wherein said metallic plates are inserted into said enclosure of said arc chamber at a distance from said contact area and said movable and fixed contact assemblies.

8. The low voltage switch pole according to claim 1, wherein said arc chamber comprises a terminal metallic plate positioned at said insulating wall.

9. The low voltage switch pole according to claim 8, wherein said channel opens into said arc extinguishing area between said terminal metallic plate and said front wall.

10. A low voltage switch which comprises a low voltage switch pole according to claim 1.

11. The low voltage switch pole according to claim 2, wherein said channel connects a middle portion of said contact area with a terminal portion of said arc extinguishing area.

12. The low voltage switch pole according to claim 2, wherein said insulating wall is positioned in said internal space opposite to said fixed contact assembly.

13. The low voltage switch pole according to claim 3, wherein said insulating wall is positioned in said internal space opposite to said fixed contact assembly.

14. The low voltage switch pole according to claim 2, wherein said insulating wall is positioned in said internal space in correspondence of the open position of said movable contact assembly.

15. The low voltage switch pole according to claim 3, wherein said insulating wall is positioned in said internal space in correspondence of the open position of said movable contact assembly.

16. The low voltage switch pole according to claim 4, wherein said insulating wall is positioned in said internal space in correspondence of the open position of said movable contact assembly.

17. The low voltage switch pole according claim 2, wherein said insulating wall is integral with said front wall and said lateral walls of said insulating casing and extends in said internal space from said front wall towards said fixed contact assembly and said rear wall.

18. The low voltage switch pole according claim 3, wherein said insulating wall is integral with said front wall and said lateral walls of said insulating casing and extends in said internal space from said front wall towards said fixed contact assembly and said rear wall.

19. The low voltage switch pole according claim 4, wherein said insulating wall is integral with said front wall and said lateral walls of said insulating casing and extends in said internal space from said front wall towards said fixed contact assembly and said rear wall.

20. The low voltage switch pole according to claim 6, A low voltage switch pole comprising an insulating casing having lateral walls and a front and a rear wall and defining an internal space with a contact area and an arc extinguishing area, a fixed contact assembly and a movable contact assembly being positioned in said contact area, said movable contact assembly being movable between a closed position in which it is into contact with said fixed contact assembly and an open position in which it is spaced apart from said fixed contact assembly, an arc chamber comprising a plurality of substantially parallel metallic plates inserted into an enclosure made of insulating material being positioned in said arc extinguishing area, characterized in that an insulating wall is positioned in said internal space between said contact area and said arc extinguishing area and partially separates said contact area from said arc extinguishing area, and in that a channel connecting said contact area to said arc extinguishing area is provided in said insulating wall:

wherein said insulating wall is integral with said front wall and said lateral walls of said insulating casing and extends in said internal space from said front wall towards said fixed contact assembly and said rear wall;

wherein said insulating wall has a terminal edge in correspondence of a middle portion of said contact area and in that said channel has a first opening communicating with said contact area proximate to said terminal edge and a second opening communicating with said arc extinguishing area proximate to said front wall.

21. A low voltage switch pole comprising:

an insulating casing having lateral walls and a front and a rear wall and defining an internal space with a contact area and an arc extinguishing area, a fixed contact assembly and a movable contact assembly being positioned in said contact area, said movable contact assembly being movable between a closed position in which it is into contact with said fixed contact assembly and an open position in which it is spaced apart from said fixed contact assembly, an arc chamber comprising a plurality of substantially parallel metallic plates inserted into an enclosure made of insulating material being positioned in said arc extinguishing area;

wherein an insulating wall is positioned in said internal space between said contact area and said arc extinguishing area and partially separates said contact area from said arc extinguishing area;

wherein said contact area and said arc extinguishing area are in direct communication with each other in a region near the front wall of said insulating casing, opposite to said fixed assembly;

wherein said contact area and said arc extinguishing area are isolated one from each other by said insulating wall in the region near said fixed assembly; and wherein a channel connects said contact area to said arc extinguishing area is provided in said insulating wall to allow passage of hot gases formed during arc formation.

* * * * *